US006045716A

United States Patent [19]

Walsh et al.

[11] Patent Number: 6,045,716

[45] Date of Patent: Apr. 4, 2000

[54] CHEMICAL MECHANICAL POLISHING APPARATUS AND METHOD

[75] Inventors: Thomas Walsh, Templeton, Calif.; Dan Trojan, Phoenix, Ariz.

[73] Assignee: Strasbaugh, San Luis Obispo, Calif.

[21] Appl. No.: 08/892,795

[22] Filed: Jul. 15, 1997

Related U.S. Application Data

[60] Provisional application No. 60/036,298, Mar. 12, 1997.

[51] Int. Cl.[7] ..... B44C 1/22

[52] U.S. Cl. ..... 216/88; 438/692; 438/693

[58] Field of Search ..... 438/692, 693; 451/285, 292; 156/345; 216/88, 89

[56] References Cited

U.S. PATENT DOCUMENTS 5,804,507 9/1998 Perlov et al. ..... 438/692

*Primary Examiner*—Randy Gulakowski

*Assistant Examiner*—Shamim Ahmed

*Attorney, Agent, or Firm*—Townsend and Townsend and Crew LLP

[57] ABSTRACT

Technique including a method 400 and an apparatus 100 for chemical mechanical polishing using a plurality of carrier devices 123 rotatably coupled to a turret means. The apparatus 100 includes a turret and plurality of rotatable polishing surfaces 111 positioned around the turret. The apparatus also includes a plurality of carrier devices 123 rotatably coupled to the turret, where the carrier devices 123 are each adapted to hold a workpiece to be polished on at least one of the rotatable polishing surfaces. Each of the carrier devices is operably independently to each other during a process for chemical mechanical polishing.

14 Claims, 5 Drawing Sheets

CHEMICAL MECHANICAL POLISHING APPARATUS AND METHOD

This application claims the benefit of U.S. Provisional Application No. 60/036,298 filed Mar. 12, 1997, the disclosure of which is incorporated by reference.

BACKGROUND OF THE INVENTION

The present invention relates to the manufacture of integrated circuits. More particularly, the invention provides a technique including a method and an apparatus for chemical mechanical polishing using a multi-carrier turret design for improved throughput and processing purposes, as well as other purposes.

Chemical mechanical polishing or planarization ("CMP") is a technique of polishing materials including semiconductor substrates and films overlying such substrates, which provides a high degree of uniformity and planarity. The process is used to remove high elevation features on films created during the fabrication of a microelectronic circuitry on the substrate, or to remove a layer of film to reveal the circuitry buried underneath the film. In some cases, the process can even planarize semiconductor slices prior to the fabrication of microelectronic circuitry thereon.

A conventional chemical mechanical polishing process uses an apparatus having a single large polishing pad positioned on a platen, against which a substrate is positioned for polishing. A positioning member positions and biases the substrate to be polished against the polishing pad, which is rotating. A chemical slurry, which is likely to have abrasive materials, is maintained on the polishing pad to modify the polishing characteristics of the polishing pad and to enhance the polishing of the substrate or films.

Unfortunately, chemical mechanical polishing is not free from limitations in the manufacture of integrated circuits. For instance, CMP is extremely time consuming, which generally influences wafer throughput. Additionally, the polishing pad often accumulates residual by-products from the polishing operation or wears and deforms the polishing pad, which leads to degradation of the polishing efficiency for the polishing operation. Furthermore, the apparatus with the single polishing pad can only perform a single process such as dielectric layer polishing or tungsten film polishing, thereby requiring an additional apparatus to perform other processes. Accordingly, conventional chemical mechanical polishing has a variety of limitations.

From the above, it is seen that a technique for chemical mechanical polishing which is cost effective and efficient is often desirable.

SUMMARY OF THE INVENTION

According to the present invention, an improved technique for chemical mechanical polishing is provided. In particular, the technique uses an apparatus having a multi-head turret for providing chemical mechanical polishing using one of a plurality of polishing surfaces.

In a specific embodiment, the present invention provides an apparatus for chemical mechanical polishing using a plurality of carrier devices rotatably coupled to a turret means. The apparatus includes the turret means and a plurality of rotatable polishing surfaces (e.g., rotating polishing pad and platen) positioned around the turret means. The apparatus also includes a plurality of carrier devices and rotatably coupled to the turret, where the carrier devices are each adapted to hold a workpiece (e.g., a wafer, a semiconductor wafer, a patterned semiconductor wafer, a plate, hard drives, a display panel, a substrate, and magneto resistive read-write heads) to be polished on at least one of the rotatable polishing surfaces. Each of the carrier devices is operably independent to each other during a process for chemical mechanical polishing. Accordingly, each of the carrier devices can move freely in three dimensions, e.g., vertical, radial, and angular, i.e., rotational or tangential.

In an alternative specific embodiment, the present invention provides a method of processing a surface of a workpiece, e.g., a wafer, a semiconductor wafer, a patterned semiconductor wafer, a plate, a display panel, hard drives, a substrate, and magneto resistive read-write heads. The method includes providing a first workpiece and a second workpiece onto a load/unload station. The first workpiece is positioned against a first surface of one of a plurality of rotatable polishing surfaces by way of a first carrier device, and the second workpiece is positioned against a second surface of one of the plurality of rotatable polishing surfaces by way of a second carrier device. These workpieces can be positioned on the surfaces independent of each other by way of the carrier devices mounted on a novel turret design and other features, which will be described in detail below.

Benefits are achieved using the present invention. In particular, the multi-carrier design allows for higher wafer throughput over pre-existing techniques. Additionally, a variety of polishing processes (or recipes) can be performed using the present apparatus. Furthermore, each of the carriers can be adjusted in two or three dimensions independent of each other to achieve desired processing conditions. These benefits and others are further described throughout this specification.

The present invention achieves these benefits in the context of known process technology. However, a further understanding of the nature and advantages of the present invention may be realized by reference to the latter portions of the specification and attached drawings.

DETAILED DESCRIPTION OF SPECIFIC EMBODIMENTS

The present invention provides a technique including a method and an apparatus for performing CMP or the like. In an exemplary embodiment, the present invention uses a novel turret design, which allows for multiple CMP operations to be performed independently, but at the same time. The present invention also provides a novel method of performing a CMP process using the novel turret design according to another embodiment. Since more than one process can be performed at the same time, the present method and apparatus have higher throughput than pre-existing techniques. Accordingly, the present invention is more cost effective and efficient than pre-existing techniques.

Figure 1:
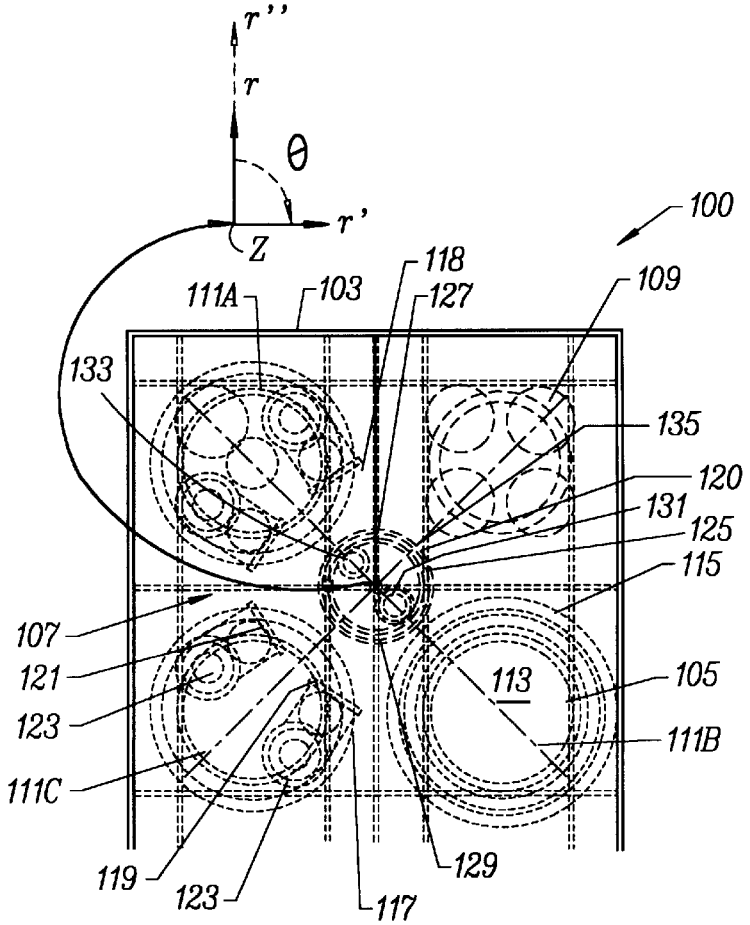
FIG. 1 is a simplified top-view diagram of a CMP apparatus according to the present invention.

FIG. 1 is a simplified top-view diagram of a CMP apparatus 100 according to the present invention. This diagram is merely an illustration and should not limit the scope of the claims herein. One of ordinary skill in the art would recognize other variations, alternatives, and modifications. To assist the reader in understanding the various features of the present invention, a spatial coordinate system is defined on the CMP apparatus. As shown, a vertical axis is defined by reference letter "z," which protrudes upwardly from and along the center region of the turret in an axial manner. A radial axis is defined by reference letter "r," which protrudes radially from the center region. Also shown is "r'," which defines movement away from the center region in a radial manner. An angle "θ," which ranges from a zero point at "r" and increases in a clock-wise manner to "r'," defines an angular or rotational or tangential coordinate, which is the final coordinate defamed on the present CMP apparatus. This coordinate system will be referenced throughout the present specification and most particularly below.

The CMP apparatus 100 includes a variety of features for polishing a surface of a workpiece, e.g., semiconductor wafer, substrate, glass, or a film of material such as a conductive film or a dielectric film on a workpiece. The conductive film can be crystalline, polycrystalline, or amorphous, and include materials such as silicon, polysilicon, amorphous silicon, copper, tungsten, aluminum, titanium, platinum, silicides, polycides, alloys of these conductive materials, multilayered materials, and others. The dielectric layers include, among others, silicon dioxide, silicon nitride, doped and undoped oxides (e.g., borophosphosilicate ("BPSG") glass, phosphorus doped ("PSG") glass, fluorinated glass), tetraethylorthosilicate ("TEOS"), plastics, combinations thereof, and multilayered materials. The CMP apparatus 100 includes an enclosed housing 103, which generally encases a processing area having at least three sections, but can include a variety of others. These sections include a polishing area 105, handling means 107, and a wafer loading and unloading area 109, which are all described in more detail below.

The housing 103 is often made of removable panels disposed on a rigid frame structure. The removable panels enclose or encase the processing area, which tends to generate particulate contamination from the CMP process, including polishing pad and chemicals. The panels are removable for maintenance, safety reasons,and the like. Preferably, the panels are made of durable chemical resistant material, which can also have insulating qualities to reduce the amount of noise generated from the processing area. In most embodiments, the panels include outer regions made of a plastic material (e.g., polyvinylchloride, polypropylene) or a light weight fiberglass material that is disposed against an insulating material to reduce noise originating from the processing area. The panels generally form a "box-like" structure supported by a frame to encase the processing area. The frame is generally made of a strong and rigid material such as steel, stainless steel, and the like. Preferably, a chemical resistant coating (e.g., epoxy, chemical resistant paint, nickel plate, anodizing) is applied to the frame to protect the frame from chemicals in the processing area. The panels and doors also have exposed regions (e.g., clear glass, transparent plastic) for viewing or accessing the processing area. Additional regions of the housing include openings to access the control panel and the like. Of course, the type of housing used depends highly upon the application.

Figure 1A:
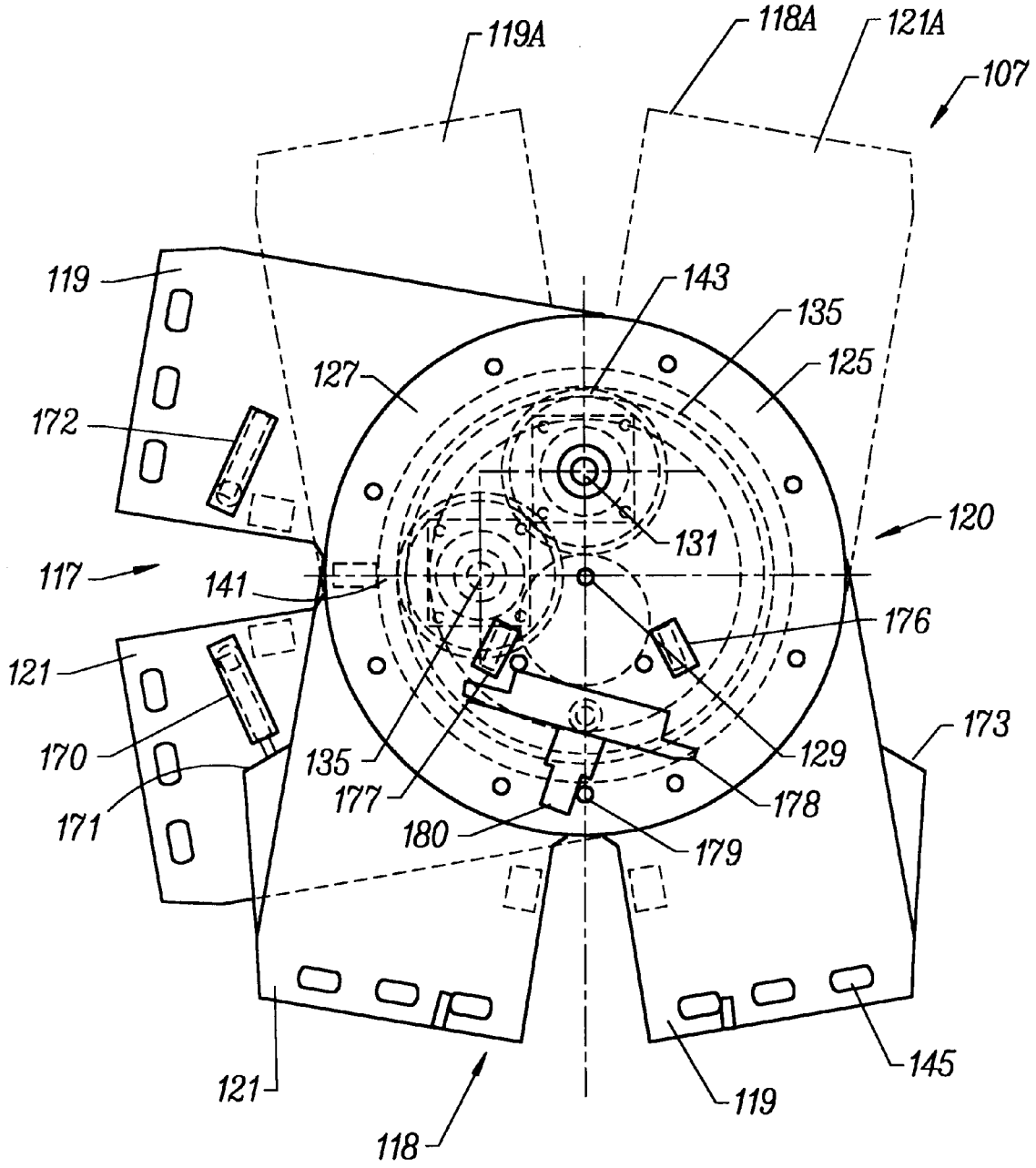
FIG. 1A is a more detailed top-view diagram of a turret assembly for the CMP apparatus of FIG. 1 according to the present invention.

The handling means 107 includes two leaf structures 117, 118 rotatably coupled to a turret, which are also shown in FIG. 1A. FIG. 1A uses similar reference numerals as FIG. 1 for easy reading. The two leaf structures protrude outwardly in a radial direction from the turret 120 to access regions overlying each of the three polishing surfaces 111. Each of the leaf structures 117, 118 include two fingers 119, 121 each of which includes a carrier device 123 attached to the end of the finger 119, 121. As shown, a preferred leaf structure includes at least two fingers 119, 121 coupled or connected directly to each other, but is not limited to these two fingers. For example, other embodiments use a single finger to support a single carrier. Alternatively, other embodiments use more than two fingers such as three fingers, four fingers, five fingers, or more fingers, each having at least one carrier device attached thereto. Of course, the number of fingers on each leaf structure used depends upon the application.

Each leaf structure rotates about the turret 120 in a relatively independent manner or a "scissor" like manner. In particular, leaf structure 117 rotates about the turret independently from leaf structure 118. To illustrate the concept of independent movement among the two leaf structures, they can be defined as leaf structure 118 and leaf structure 117, which rotate independently from each other, depending upon the process or application. For example, the leaf structure 118 can rotate about the turret to move the workpiece to polishing surface 111(A) or to polishing surface 111(B), as shown in FIG. 1, for example. Leaf structure 117 can also rotate from either polishing surface 111(C) or polishing surface 111 (B) to move the workpiece to the load/unload station 109 or pick up a workpiece from the load/unload station. Leaf structure 117 can rotate about the turret to the load/unload station, as well as rotate to one or more of the polishing surface(s). In reference to FIG. 1A, for example, leaf structure 118 moves from a first position to a second position a shown by leaf structure 118(A), which includes fingers 119(A) and 121(A). Preferably, the leaf structures can not cross over each other to prevent a possibility of a collision between the two leaf structures. Accordingly, each leaf structure has mechanical stops attached thereto to prevent collisions.

For instance, leaf structure 118 is aligned and is positioned with respect to leaf structure 117. As shown, leaf structure 118 includes stops 171, 173. Leaf structure 118 rotates in a counter-clockwise manner about center region 129 and relative to leaf structure 117 until stop 173 comes in contact with stop 172, which is defined on leaf structure 117. Alternatively, leaf structure 118 rotates in a clockwise manner about center region 129 and relative to leaf structure 117 until stop 171 comes in contact with stop 170, which is defined on leaf structure 117. Alternatively, leaf structure 118 rotates either in a clockwise or counter clockwise manner relative to leaf structure 117 until one of the stops collide with either stops 170 or 172. Leaf structure 118 also includes stops in the turret (or column) 120. For example, leaf structure 118 includes stops 176, 177, and 178, which allow leaf structure 118 to stop a selected regions relative to the turret, but allow for greater than a 360° rotation about the center region 129. Additionally, the combination of leaf structures may also include a stop pin 180, which limits the movement of these structures relative to the internal drive gears.

Each leaf structure, including fingers, is made of a substantially rigid material to support at least one carrier device 123, but can support others. The leaf structure is often made of a high grade steel, stainless steel, or the like, which has a sufficient thickness to support the carrier device and withstand pressure as required by a variety of processes. A chemical resistant material or coating can be applied to the leaf structure in preferred embodiments to withstand any aggressive chemicals, which may attack the leaf structure, from the processing area. Alternatively, the leaf structure can be made of an extremely high grade stainless steel (e.g., 303 or 304 stainless), which has been passivated (e.g., oxidized) to prevent chemical attack of the stainless steel material.

In operation, each leaf structure rotates horizontally about the turret along a fixed plane. Depending upon the application, rotation speed can vary. For example, each leaf structure can move in a constant, graduated, or stepped manner or rate around the turret and relative to each other. The rate is about 30 degrees per second ("DPS"). To transfer a workpiece from the load/unload station to a processing region overlying the polishing surfaces, for example, the leaf structure moves at least 30 DPS, excluding start-up or slow-down. During a polishing process, each leaf structure moves the carrier over the polishing surface at a rate ranging from about 0 DPS to about 10 DPS. These rates are often programmable. Additionally, the length of movement or "stroke" is also programmable. In most embodiments, each leaf structure accelerates to about 30 DPS in about ½ second, but can also accelerate at other rates. Additionally, each leaf structure can also operate in a slow speed mode to a fast speed mode, with other speeds in between.

Each leaf structure attaches to an annular shaped member 125, 127 which can freely rotate about a center region 129 of the turret. The annular shaped member is actually a bearing or bushing assembly and also supports the leaf structure about the turret in a rotatably coupled manner. The bearing or bushing assembly facilitates the rotational movement of the annular shaped member about the turret center region 129. Leaf structure 118 includes annular shaped region 127, and leaf structure 117 includes annular shaped region 125. An annular shaped gear or wheel drives each of the leaf structures. Preferably, an independent gear or wheel is used to drive each of the leaf structures in an independent manner.

As shown, gear wheel 131 drives leaf structure 117 and gear wheel 133 drives leaf structure 118. Gear wheel 131 includes an outer gear periphery 143 and gear wheel 133 includes an outer gear periphery 141. To move the annular shaped member, each gear wheel or outer gear can intermesh into a gear or "ring" gear assembly 135 defined on the inner periphery of the annular shaped member to drive the annular shaped member in a rotational manner about the center 129 of the turret. Alternatively, the annular shaped gear or wheel includes an outer surface that is relatively smooth, but has a large coefficient of friction relative to an inner periphery of the annular shaped member to drive the annular shaped member in a rotational manner about the center of the turret. This outer surface can be a "sticky" plastic material, rubber, or the like. As merely an example, the annular shaped gear or wheel is similar to "trucks" an a skateboard.

Each leaf structure includes a carrier device 123, which holds a workpiece to be polished on at least one of the polishing surfaces. A plurality of holes 145 are used to attach each carrier device to each leaf structure. Preferably, each carrier device is removable from the leaf structure by way of attachment means, e.g., bolts, screws, pins. By way of such attachment means, each carrier device can be removed and/or replaced for repair and preventive maintenance purposes. In some embodiments, one or more of the carrier devices is removed without interfering the operation of the other carrier devices.

The polishing area 105 has a plurality of polishing surfaces 111 (e.g., round wheels) disposed around handling means or turret 120. Each of the polishing surfaces 111 generally includes a polishing pad 113 defined overlying a rotatable platen assembly 115. The polishing pad 113 is a disk-shaped object having the polishing surface 111, which is rotatable about a fixed plane and axis. In preferred embodiments, the disk-shaped object is rotatable at a constant and varying speeds. For example, the disk-shaped object rotates at a speed greater than about 200 revolutions per minute ("RPM"), but less than about 2 RPM. Preferably, the speed of rotation ranges from about 10 RPM to about 150 RPM, but is often less than about 70 RPM. The disk-shaped object can accelerate to a speed of about 70 RPM in about 2 seconds or less, but can also be set at other acceleration rates. An electric motor often drives the disk-shaped object about a fixed plane axis in the z-direction. The motor can drive the disk-shaped object directly or through a drive train, e.g., gears, belts. Preferably, the electric motor is a brushless servo motor made by Sierracin or Kollmorgen, but can also be others.

The polishing pad 113 is often made of a tough "fabric-like" chemical resistant material, which is often embedded with an abrasive material. The polishing pad can be made from a material such as a poly-urethane, polyester, acrylic, acrylic ester copolymers, poly tetra-fluoroethylene, polypropylene, polyethylene, poly 4-methyl pentene, cellulose, cellulose esters, polyamides such as nylon and aramids, polyimides, polyimideamide, polysiloxane, copolymers, polycarbonates, epoxides, phenolic resins, and others. Of course, the type of material used depends upon the A application. An example of this polishing surface made of a poly-urethane material is a product sold by Rodel called IC-1000, but can be others. In most embodiments, the abrasive is a plurality of particles, which are selected from a material such as a borosilicate glass, titanium dioxide, titanium nitride, aluminum oxide, aluminum trioxide, iron nitrate, cerium oxide, silicon dioxide (colloidal silica), silicon nitride, silicon carbide, graphite, diamond, and any mixtures thereof. The type of particle used depends highly upon the CMP application, e.g., tungsten, dielectric, oxide, nitride. The abrasive is often mixed in a solution (e.g., water, acid, base, organic solvent) to form a slurry, which can be applied to the polishing pad in a manual or automated manner.

Figure 2:
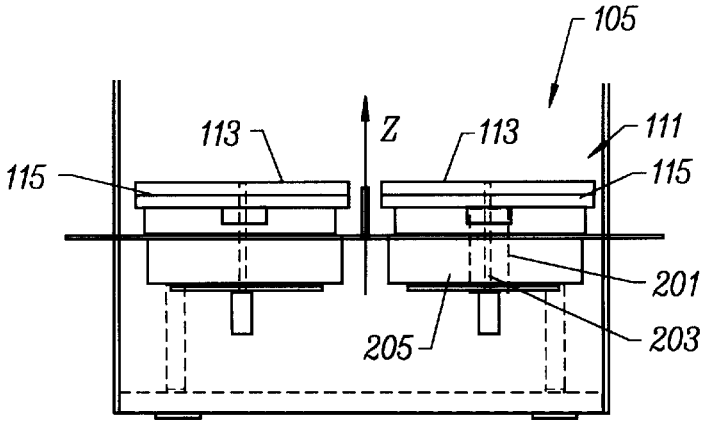
FIG. 2 is a simplified side-view diagram of polishing tables for the CMP apparatus of FIG. 1 according to the present invention.

A simplified side-view diagram of the polishing area 105 is shown by way of FIG. 2, for example. This diagram is merely an illustration and should not limit the scope of the claims herein. One of ordinary skill in the art would recognize other modifications, alternatives, and variations. As shown, FIG. 2 uses like reference numerals as the other Figs. for easy reading. The polishing area 105 includes polishing surface(s) 111, polishing pad(s) 113, and rotatable platen assembly 115. Each of the polishing pads includes an upper surface having the same or similar height relative to the z-axis. To rotate platen assembly 115, axle 203 drives the platen assembly by way of an attachment to a center region of the assembly. Axle 203 also inserts into annular region 201, which houses the axle. Axle 203 moves in or rotates in annular region 201 by way of force applied to the axle by a drive assembly 205, which is defined below the rotatable platen assembly. Axle 203 drives or rotates the platen assembly in a constant, varying, or stepped manner. For example, platen assembly rotates at a speed ranging from about 2 RPM to about 200 RPM. Preferably, rotation occurs at a speed greater than about 30 RPM during processing, but also can be others.

Figure 3:
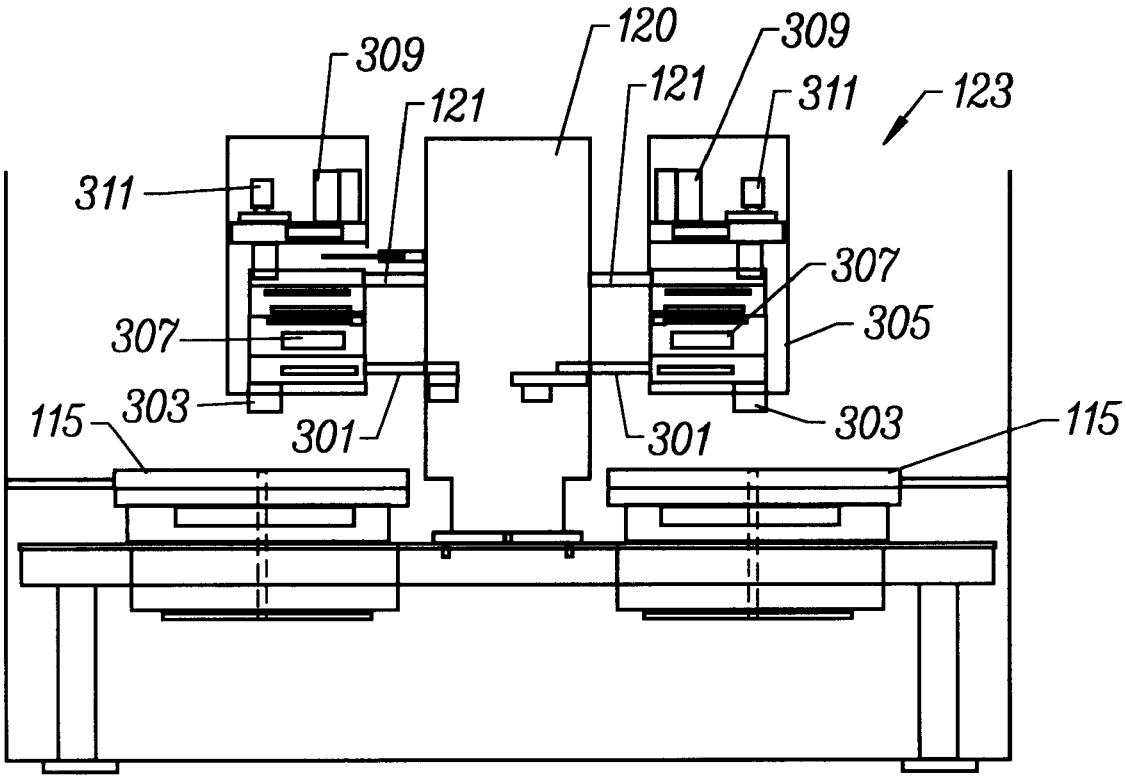
FIG. 3 is a simplified side-view diagram of carrier devices for the CMP apparatus of FIG. 1 according to the present invention.

In relation to the handing means, including the leaf structure(s), a simplified side view diagram of the polishing area is shown by FIG. 3. This diagram is merely an illustration and should not limit the scope of the claims herein. The diagram includes, among other features, the polishing area 105, and the polishing surfaces. As shown, each of the polishing surfaces 115 is disposed around the handing means, including the turret 120 and the leaf structure(s) 118, 301. As shown, each leaf structure includes two fingers 119, 121. These fingers were actually upper fingers. Additionally, each leaf structure includes lower fingers 301, which are directly below upper fingers 121. The leaf structure further includes lower fingers (not shown) directly below upper fingers 119. Between each pair of lower and upper finger is the carrier device 123. That is, each pair of fingers holds the carrier device in parallel alignment to the polishing surface.

Each carrier device 123 includes an actuator or bellows device 307 between the fingers for adjusting the vertical or z-location of a workpiece held by a workpiece carrier (not shown) relative to the polishing surfaces. The bellows device has a range of operation greater than about 3 ½ inches or preferably greater than about 4 inches, which is measured from an upper point along the z-axis and a lower point along the z-axis. Bellows device 307 also provides force in the z-direction to the backside surface of the workpiece held by a workpiece carrier. In a specific embodiment, the force ranges from about 0 pounds to about 850 pounds and can be others. This force provides a pressure of about 300 pounds and greater to, for example, an eight inch wafer, which is biased against the polishing surface.

The workpiece carrier is attached to the end of a rotatable spindle 303. Spindle 303 is defined in a z-direction in the carrier device and is held by at least the bellows device. To drive the spindle in a rotational manner, spindle 303 is coupled to a drive assembly 311, which is driven by an electric motor (e.g., servo motor) 309. An example of this electric motor is a product manufactured by Animatics or Infranor, but can be others. A housing 305 encloses the spindle 303 and bellows 307 to protect them from the environment.

The apparatus can be fully automatic or manual by way of at least the above handling means which is coupled to a controller (not shown). A method according to the present invention may be briefly outlined as follows:

(1) Provide plurality of workpieces to be processed in a workpiece carrier or boat;

(2) Transfer first workpiece (e.g., wafer having a film of tungsten, copper, aluminum, or dielectric material thereon) to an alignment station;

(3) Align first workpiece;

(4) Transfer first workpiece onto a load/unload station;

(5) Position first workpiece on load/unload station to a first carrier of a first leaf structure;

(6) Pick-up first workpiece using the first carrier;

(7) Position first workpiece for processing onto first processing surface, which is rotatable;

(8) Perform steps (1) to (6) for a second workpiece using a second carrier of a second leaf structure and then;

(9) Position second workpiece using second leaf structure for processing onto a second processing surface, which is rotatable;

(10) Transfer first or second workpiece to load/unload station;

(11) Transfer second or first workpiece to load/unload station;

(12) Transfer first workpiece into workpiece carrier using first leaf structure;

(13) Transfer second workpiece into workpiece carrier using second leaf structure;

(14) Perform remaining fabrication steps, as necessary.

The above sequence of steps are used to planarize a workpiece or planarize a film on a workpiece. These steps generally include the use of multiple carrier devices, which can each hold a workpiece for polishing, independently from each other. Accordingly, each carrier device can be adjusted independently to independently maintain processing conditions. Additionally, the multiple carrier devices can provide, for example, high throughput and workpiece processing. Again, these steps are merely examples and should not limit the scope of the claims herein. Details of the steps can be shown in a simplified flow diagram and the description below.

Figure 4:
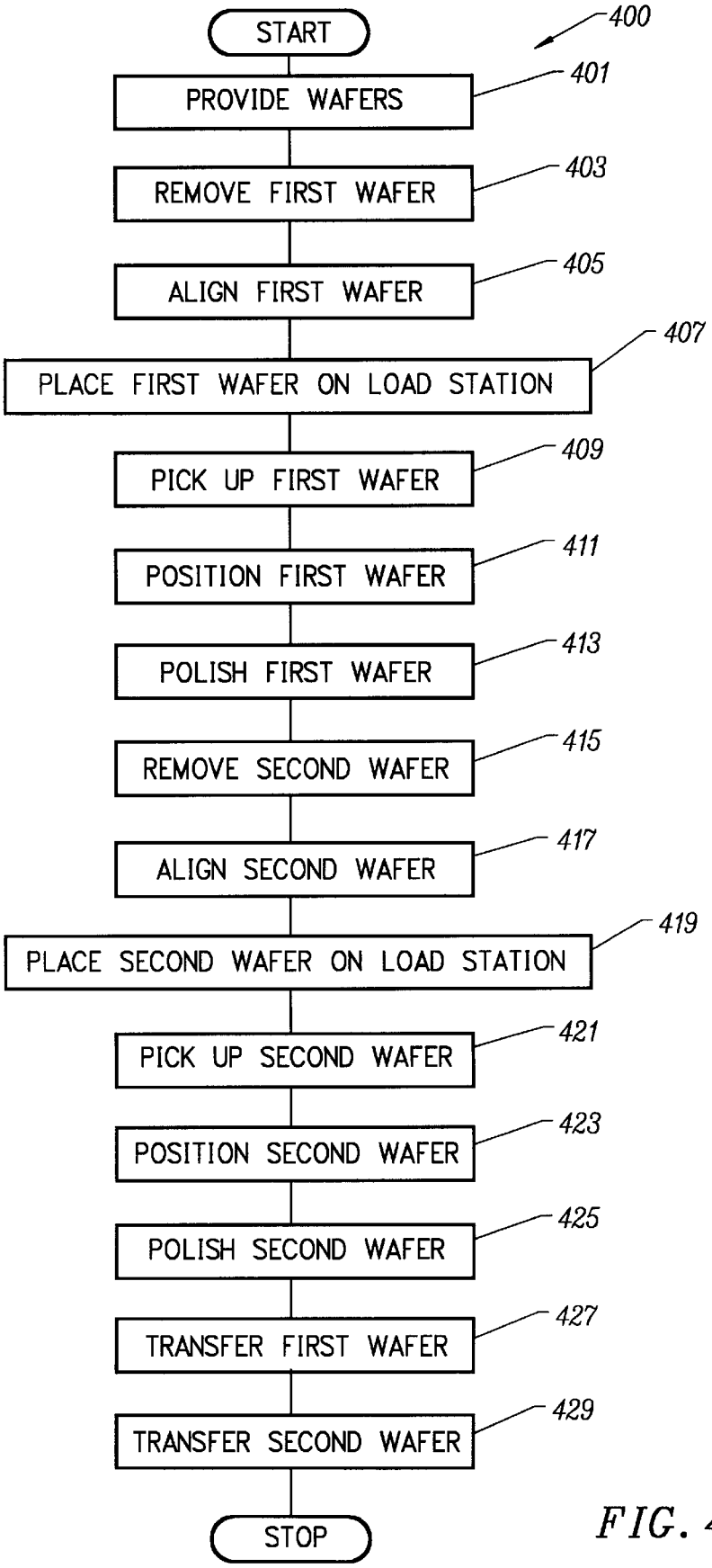
FIG. 4 is a simplified flow diagram of a method according to the present invention.

FIG. 4 is a simplified flow diagram of a method 400 according to the present invention. This method is merely an example and should not limit the scope of the claims herein. One of ordinary skill in the art would recognize other modifications, variations, and alternatives. The method generally describes a process of planarizing a tungsten film on a semiconductor wafer, for example.

The method 400 begins by providing (step 401) a plurality of wafers having a film of tungsten thereon to be processed in a carrier, e.g., wafer boat. A first wafer is removed (step 403) by way of a pick-up arm from the carrier and placed on an alignment station, which aligns (step 405) the wafer flat to a desired position. The first wafer is placed (step 407) on a load/unload station, which rotates to align the first wafer to a position to be picked up by a first carrier.

The first carrier rotates about the turret and positions its carrier head over the first wafer. The first carrier uses its bellows device to adjust the carrier head to a position directly overlying the wafer to pick up the wafer. Mechanical clamps secure the wafer to pick up (step 409) the wafer and vacuum secures the wafer to the carrier head. The bellows device adjusts the z-position of the wafer upwardly. The first carrier rotates about the turret to position (step 411) the wafer overlying a first polishing surface. The bellows device adjusts the z-position of the wafer downwardly such that the face of the wafer is biased against the polishing surface to perform the polishing operation (step 413). The polishing surface is generally rotated by way of a drive mechanism to enhance the polishing action. Additionally, a spindle rotates the wafer in a circular manner to further enhance polishing in some embodiments.

In a specific embodiment, a slurry mixture is applied directly to the polishing surface to enhance removal of tungsten material. This slurry mixture can be transferred to the polishing pad by way of a metering pump, which is coupled to a slurry source. The slurry is often a solution containing an abrasive particle and oxidizer, e.g., $H_2O_2$, $KIO_3$, ferric nitrate. The abrasive particle is often a borosilicate glass, titanium dioxide, titanium nitride, aluminum oxide, aluminum trioxide, iron nitrate, cerium oxide, silicon dioxide (colloidal silica), silicon nitride, silicon carbide, graphite, diamond, and any mixtures thereof. In a tungsten process, a preferred abrasive particle is aluminum oxide. This particle is mixed in a solution of deionized water and oxidizer or the like. Preferably, the solution is also acidic.

Independent to the operation of the first carrier, a second carrier undergoes the following processing steps to perform chemical mechanical planarization of a second wafer. A second wafer is removed (step 415) by way of a pick-up arm from the carrier and is placed on an alignment station, which aligns (step 417) the wafer flat to a desired position. The second wafer is placed (step 419) on a load/unload station, which rotates to align the second wafer to a position to be picked up by a second carrier.

The second carrier rotates about the turret and positions its carrier head over the second wafer. The second carrier uses its bellows to adjust the second carrier head to a position directly overlying the wafer to pick up the wafer. Mechanical clamps secure the wafer to pick up (step 421) the wafer, and vacuum secures the wafer to the carrier head. The bellows device adjusts the z-position of the wafer upwardly. The second carrier rotates about the turret to position (step 423) the wafer overlying a second polishing surface for polishing (step 425). The bellows device adjusts the z-position of the wafer downwardly such that the face of the wafer is biased against the polishing surface. The polishing surface is generally rotated by way of a drive mechanism to enhance the polishing action. Additionally, a spindle rotates the wafer in a circular manner to further enhance polishing, if desired.

After the polishing operation of the first wafer is completed, the first wafer is transferred (step 427) to the load/unload station. In particular, the bellows device adjusts the z-location of the wafer upwardly away from the polishing surface. The turret rotates the first carrier to a region overlying the load/unload station. The bellows device adjusts the z-location downwardly toward the load/unload station. The vacuum holding the wafer releases the wafer. The bellows device adjusts the carrier upwardly and the turret rotates the carrier away from the load/unload station so that the second wafer can be removed. Alternatively, the first carrier picks up another wafer to be processed and undergoes another polishing process.

The second wafer is also transferred to the load/unload station after polishing is completed in an independent manner relative to the first wafer. In particular, the bellows device adjusts the z-location of the wafer upwardly away from the polishing surface. The turret rotates the second carrier to a region overlying the load/unload station. The bellows device adjusts the z-location downwardly toward the load/unload station. The vacuum holding the wafer releases the wafer. The bellows device adjusts the carrier upwardly and the turret rotates the carrier away from the load/unload station so that the first wafer can be removed, if necessary. Alternatively, the second carrier picks up another wafer to be processed and undergoes another polishing process. Of course, these sequences of steps are merely an illustration which should not limit the scope of the claims herein.

In an alternative embodiment, the present invention provides a method, which may be briefly outlined as follows:

(1) Provide plurality of workpieces to be processed in a workpiece carrier or boat;

(2) Transfer first workpiece (e.g., wafer having a film of tungsten, copper, aluminum, or dielectric material thereon) to an alignment station;

(3) Align first workpiece;

(4) Transfer first workpiece onto a load/unload station;

(5) Transfer second workpiece (e.g., wafer having a film of tungsten, copper, aluminum, or dielectric material thereon) to an alignment station;

(6) Align second workpiece;

(7) Transfer second workpiece onto a load/unload station;

(8) Position first and second workpieces on load/unload station to a first carrier and a second carrier, respectively, on a first leaf structure;

(9) Pick-up first and second workpieces using the first carrier and the second carrier;

(10) Position first and second workpieces for processing onto first processing surface, which is rotatable and polishes wafers;

(11) Transfer polished first and second workpieces to load/unload station;

(12) Transfer first (or second) workpiece into workpiece carrier;

(13) Transfer second (or first) workpiece into workpiece carrier;

(14) Perform remaining fabrication steps, as necessary.

The above sequence of steps are used to planarize at least two workpieces or planarize a film on two workpieces using a single leaf structure. While the first and second workpieces are being polished, a second leaf structure can begin processing third and fourth workpieces simultaneously. For example, the method can process third and fourth workpieces using the second leaf structure performing steps (2)–(10) above, while the first leaf structure is polishing the first and second workpieces. These steps generally include the use of at least two carrier devices, which can each hold a workpiece for polishing, on a single leaf structure, which can be processed independently from another leaf structure. Accordingly, at least two carrier devices can be adjusted independently to independently maintain processing conditions. Additionally, the multiple carrier devices can provide, for example, high throughput of workpieces. Again, these steps are merely examples and should not limit the scope of the claims herein. Details of the steps can be shown in a simplified flow diagram and the description below.

Figure 5:
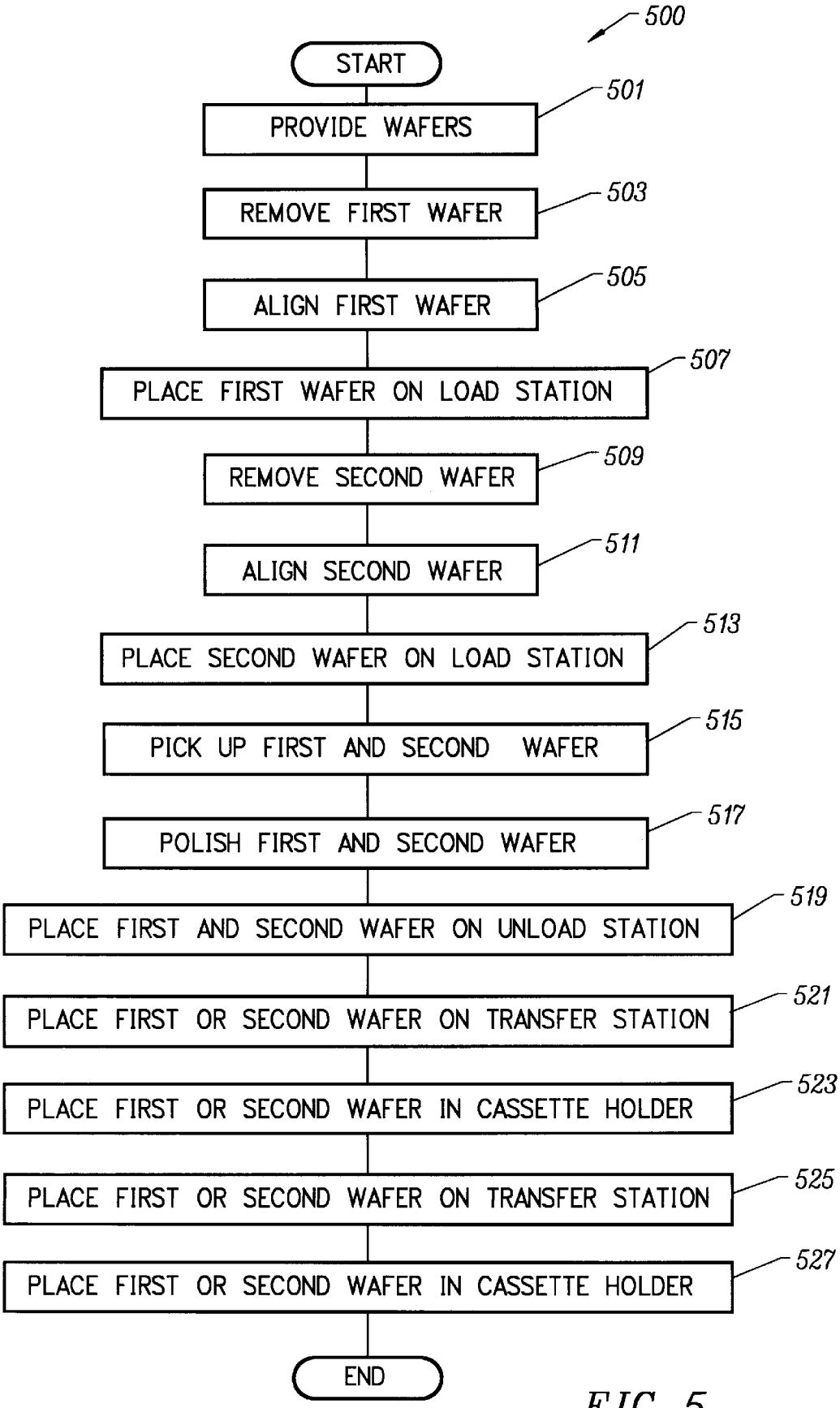
FIG. 5 is a simplified flow diagram of an alternative method according to the present invention.

FIG. 5 is a simplified flow diagram of a method 500 according to the present invention. This method is merely an example and should not limit the scope of the claims herein. One of ordinary skill in the art would recognize other modifications, variations, and alternatives. The method generally describes a process of planarizing a tungsten film on a semiconductor wafer, for example, by way of two carrier devices on a single leaf structure, such as the one described above, but can be others.

The method 500 begins by providing (step 501) a plurality of wafers having a film of tungsten thereon to be processed in a carrier, e.g., wafer boat. A first wafer is removed (step 503) by way of a pick-up arm from the carrier and placed on an alignment station, which aligns (step 505) the wafer flat to a desired position. The first wafer is placed (step 507) on a load/unload station, which rotates to align the first wafer to a position to be picked up by a first carrier on a first leaf structure.

These steps are repeated for processing a second wafer. For example, a second wafer is removed (step 509) by way of a pick-up arm from the carrier and placed on an alignment station, which aligns (step 511) the wafer flat to a desired position. The second wafer is placed (step 513) on a load/unload station, which rotates to align the second wafer to a position to be picked up by a second carrier on the first leaf structure, which includes at least these two carrier devices.

The first leaf structure including the carriers rotates about the turret and positions its carrier heads over the first and the second wafers. The first carrier uses its bellows device to adjust the carrier head to a position directly overlying the first wafer to pick up the wafer. Mechanical clamps secure the first wafer to pick up (step 515) the first wafer and vacuum secures the wafer to the carrier head. The bellows device adjusts the z-position of the first wafer upwardly. Similarly, the second carrier head uses its bellows device to adjust the carrier head to a position directly overlying the second wafer to pick up the second wafer. Mechanical clamps secure the second wafer to pick up (step 515) the wafer and vacuum secures the wafer to the carrier head. The bellows device adjusts the z-position of the second wafer upwardly.

The first leaf structure including the carriers rotates about the turret to position the wafers overlying a first polishing surface. The bellows devices adjust the z-positions of the wafers downwardly such that the faces of the wafers are biased against the polishing surface to perform the polishing operations (step 517). The polishing surface is generally rotated by way of a drive mechanism to enhance the polishing action. Additionally, a spindle rotates each of the wafers in a circular manner to further enhance polishing in some embodiments.

In a specific embodiment, a slurry mixture is applied directly to the polishing surface to enhance removal of tungsten material. This slurry mixture can be transferred to the polishing pad by way of a metering pump, which is coupled to a slurry source. The slurry is often a solution containing an abrasive particle and oxidizer, e.g., $H_2O_2$, $KIO_3$, ferric nitrate. The abrasive particle is often a borosilicate glass, titanium dioxide, titanium nitride, aluminum oxide, aluminum trioxide, iron nitrate, cerium oxide, silicon dioxide (colloidal silica), silicon nitride, silicon carbide, graphite, diamond, and any mixtures thereof. In a tungsten process, a preferred abrasive particle is aluminum oxide. This particle is mixed in a solution of deionized water and oxidizer or the like. Preferably, the solution is also acidic.

After the polishing operations of the first and second wafers are completed, the first and second wafers are transferred (step 519) to the load/unload station. In particular, the bellows devices adjust the z-locations of the wafers upwardly away from the polishing surface. The turret rotates the first leaf structure including the carriers to a region overlying the load/unload station. The bellows devices adjust the z-locations downwardly toward the load/unload station. Vacuum holding the wafers release the wafers. The bellows devices adjust the carriers upwardly again and the turret rotates the carriers away from the load/unload station.

Each wafer is then placed or transferred into a cassette holder. For example, the first wafer is picked up and placed in the cassette holder. The second wafer is then picked up and placed in the cassette holder. Alternatively, the second wafer is picked up and placed in the cassette holder. The first wafer is then picked up and placed in the cassette holder. As noted above, a second leaf structure coupled to the turret can pick up third and fourth wafers while the first and second wafers are being processed. The use of the first and second leaf structures including at least four carrier devices allows for parallel processing of at least two or four wafers at the same time. Of course, these sequences of steps are merely illustrations and should not limit the scope of the claims herein.

Although the above description is described generally in terms of polishing a tungsten film on a wafer, it would be easily recognized that the invention has a broader range of applicability. For example, the invention can also be applied to polishing surfaces of optical materials, substrates, glass, and other films on wafers. Additionally, the above method can be used for planarizing dielectric materials such as, for example, silicon dioxide, doped and undoped oxides, and other materials. Of course, the type of workpiece used depends highly upon the application.

While the above is a full description of the specific embodiments, various modifications, alternative constructions and equivalents may be used. For example, while the description above is in terms of a multi-carrier design using a single turret, it would be possible to impent the present invention with multiple turrets and even more carriers. Therefore, the above description and illustrations should not be taken as limiting the scope of the present invention which is defined by the appended claims.

What is claimed is:

1. A method of processing a surface of a workpiece, said method comprising:

providing a first workpiece and a second workpiece;

rotating a first carrier holding said first workpiece in a rotational manner about a center region of a turret and positioning said first workpiece against a first surface of one of a plurality of rotatable polishing surfaces; and rotating a second carrier holding said second workpiece in a rotational manner about said center region of said turret and positioning said second workpiece against a second surface of one of said plurality of rotatable polishing surfaces;

wherein said step of rotating said first carrier in said rotational manner about said center region of said turret is performed in a scissor-like manner independent of said step of rotating said second carrier in said rotational manner about said center region of said turret.

2. Method of claim 1 wherein said first workpiece is held using a first carrier device and said second workpiece is held using a second carrier device.

3. Method of claim 1 wherein each of said rotatable polishing surfaces includes a polishing pad attached to a rotatable platen positioned around said turret.

4. Method of claim 1 wherein each of said plurality of rotatable polishing surfaces is defined around a turret.

5. Method of claim 1 wherein said plurality of rotatable polishing surfaces include three rotatable polishing surfaces.

6. Method of claim 1 further comprising a step of picking up said first workpiece from a load/unload station.

7. Method of claim 1 further comprising a step of picking up said second workpiece from a load/unload station.

8. Method of claim 7 wherein said workpiece is selected from a group comprising a wafer, a semiconductor wafer, a patterned semiconductor wafer, a plate, and a display panel.

9. A method of processing a surface of a workpiece, said method comprising:

providing a plurality of workpieces in a workpiece carrier said plurality of workpieces comprising a first workpiece;

transferring said first workpiece from said workpiece carrier to an alignment station;

aligning said first workpiece to a desired position;

transferring said first workpiece to a load/unload station;

positioning a first carrier in a rotational manner about a center region of a turret to said load/unload station to pick up said first workpiece from said load/unload station;

positioning said first workpiece onto a first processing surface by moving said first carrier about said center region of said turret in a rotational manner from said load/unload station to said first processing surface; and positioning a second carrier comprising a second workpiece about said center region of said turret to a second processing surface;

wherein said step of positioning said first workpiece in said rotational manner about said center region of said turret is performed in a scissor-like manner independent of said step of positioning said second workpiece about said center region of said turret to said second processing surface.

10. Method of claim 9 further comprising the step of processing said first workpiece with a polishing surface.

11. Method of claim 9 further comprising the step of processing said next workpiece with a polishing surface.

12. Method of claim 10 wherein said first polishing surface is one of three rotatable polishing surfaces.

13. Method of claim 11 wherein said second polishing surface is one of three rotatable polishing surfaces.

14. Method of claim 9 wherein said workpiece is selected from a group comprising a wafer, a semiconductor wafer, a patterned semiconductor wafer, a plate, and a display panel.

* * * * *